US011154883B2

(12) United States Patent
Yamada

(10) Patent No.: US 11,154,883 B2
(45) Date of Patent: Oct. 26, 2021

(54) ELECTROSTATIC COATING MACHINE

(71) Applicant: ABB K.K., Shinagawa-ku (JP)

(72) Inventor: Yukio Yamada, Fujieda (JP)

(73) Assignee: ABB SCHWEIZ AG, Baden (CH)

( * ) Notice: Subject to any disclaimer, the term of this patent is extended or adjusted under 35 U.S.C. 154(b) by 42 days.

(21) Appl. No.: 16/335,341

(22) PCT Filed: Aug. 16, 2018

(86) PCT No.: PCT/JP2018/030414
§ 371 (c)(1),
(2) Date: Mar. 21, 2019

(87) PCT Pub. No.: WO2019/035472
PCT Pub. Date: Feb. 21, 2019

(65) Prior Publication Data

US 2019/0283053 A1 Sep. 19, 2019

(30) Foreign Application Priority Data

Aug. 18, 2017 (JP) ..... JP2017-158031

(51) Int. Cl.
*B05B 5/04* (2006.01)
*B05B 3/10* (2006.01)
*B05B 5/053* (2006.01)

(52) U.S. Cl.
CPC ..... *B05B 5/0407* (2013.01); *B05B 3/10* (2013.01); *B05B 5/04* (2013.01); *B05B 5/0532* (2013.01); *B05B 5/0533* (2013.01)

(58) Field of Classification Search
CPC ... B05B 5/0407; B05B 5/0532; B05B 5/0533; B05B 3/10; B05B 5/0426; B05B 5/04
See application file for complete search history.

(56) References Cited

U.S. PATENT DOCUMENTS 6,565,021 B2 * 5/2003 Borner ..... B05B 5/0533 239/703
2002/0066809 A1 6/2002 Borner et al.
(Continued)

FOREIGN PATENT DOCUMENTS

CN 103721879 A 4/2014
CN 103974779 A 8/2014
(Continued)

OTHER PUBLICATIONS

Japanese Office Action dated Feb. 18, 2020, in Patent Application No. 2019-515384, 4 pages (with unedited computer generated English translation).
(Continued)

*Primary Examiner* — Steven M Cernoch
(74) *Attorney, Agent, or Firm* — Oblon, McClelland, Maier & Neustadt, L.L.P.

(57) ABSTRACT

A shield member (14) is provided on an outer peripheral side of a front surface section (9D) of a shaping air spurting member (9) and is formed of an annular body radially extending to shield electric flux lines traveling toward rotary atomizing head (4) from each of electrodes (6C) in an external electrode member (6). A tubular insulating member (15) formed of an insulating material covering an outer peripheral surface (9B) of the shaping air spurting member (9) is provided on an outer peripheral side of the shaping air spurting member (9). Further, a discharge buffering member (16) formed of an annular self-returning insulator or semi-conductive material is provided in a position where the shield member (14) is separated from the insulating member (15) between the shield member (14) and the insulating member (15).

4 Claims, 9 Drawing Sheets

(56) References Cited

U.S. PATENT DOCUMENTS

| | | | |
|---|---|---|---|
| 2011/0271906 | A1 | 11/2011 | Yamada |
| 2015/0128857 | A1 | 5/2015 | Yamada et al. |
| 2015/0136022 | A1 | 5/2015 | Yamada |
| 2015/0136023 | A1 | 5/2015 | Yamada |
| 2015/0182979 | A1 | 7/2015 | Yamada |

FOREIGN PATENT DOCUMENTS

| | | | |
|---|---|---|---|
| EP | 2 859 955 | A1 | 4/2015 |
| EP | 3 417 946 | A1 | 12/2018 |
| JP | 8-332418 | A | 12/1996 |
| JP | 2002-538957 | A | 11/2002 |
| JP | 2003-225592 | A | 8/2003 |
| WO | WO 2010/131541 | A1 | 11/2010 |
| WO | WO 2013/183416 | A1 | 12/2013 |
| WO | WO 2017/141963 | A1 | 8/2017 |

OTHER PUBLICATIONS

International Search Report dated Sep. 11, 2018, in PCT/JP2018/030414 filed on Aug. 16, 2018.

Combined Chinese Office Action and Search Report dated Jul. 1, 2020, in Patent Application No. 201880004835.0 (with English translation), 10 pages.

Euorpean Search Report issued in European Patent Application No. 18846382.2 dated Nov. 30, 2020.

* cited by examiner

ELECTROSTATIC COATING MACHINE

TECHNICAL FIELD

The present invention relates to an electrostatic coating machine that is configured to apply a high voltage to sprayed paint for coating.

BACKGROUND ART

In general, there is known an electrostatic coating machine of a rotary atomizing head type as an electrostatic coating machine. The electrostatic coating machine includes an air motor having an electric potential which is maintained at a ground level and that rotates a rotational shaft with compressed air supplied thereto, a rotary atomizing head that is provided on the front side of the rotational shaft and is composed of a tubular body having an electric potential which is maintained at the ground level to spray paint, which is supplied while being rotated by the air motor, from a releasing edge in a front end, an external electrode member that is positioned in back of the rotary atomizing head to be provided on an outer peripheral side of the air motor and electrifies paint particles sprayed from the releasing edge in the rotary atomizing head to be in a negative potential by applying a negative high voltage to a plurality of electrodes, and a shaping air spurting member that is formed in a tubular shape by using a conductive material and is arranged on an outer peripheral side of the rotary atomizing head in a state where a front end of the shaping air spurting member is positioned in an intermediate section of the rotary atomizing head in a length direction, the front end being provided with a plurality of air spurting holes over an entire circumference of the shaping air spurting member in a circumferential direction to spurt shaping air toward paint particles sprayed from the rotary atomizing head (Patent Document 1).

In a case of performing the coating by using the electrostatic coating machine as configured above, the rotary atomizing head is rotated at high speeds by the air motor, and in this state, paint is supplied to the rotary atomizing head. Therefore, the paint supplied to the rotary atomizing head is atomized by centrifugal forces generated when the rotary atomizing head rotates and is sprayed as paint particles from the releasing edge. At this time, the shaping air spurting member sprays the shaping air spurted from each of the air spurting holes to the paint particles. As a result, the shaping air spurting member controls a kinetic vector component of the paint particle in a coating object direction, thus adjusting a spray pattern of the paint particles to a desired shape.

Further, the external electrode member, by applying a negative high voltage to each of the electrodes, electrifies the paint particles sprayed from the releasing edge of the rotary atomizing head to be in the negative polarity. Thereby, the paint particles sprayed from the rotary atomizing head are indirectly electrified to be in the negative polarity. Accordingly, the electrostatic coating machine can fly the electrified paint particles along an electrostatic field formed between each of the electrodes and the coating object to cause the coating object to be coated with the paint particles.

PRIOR ART DOCUMENT

Patent Document

Patent Document 1: Japanese Patent Laid-Open No. 8-332418 A

SUMMARY OF THE INVENTION

Here, the electrostatic coating machine sprays shaping air onto paint particles flying in the radical outward from the rotary atomizing head by centrifugal forces, from each of the air spurting holes in the shaping air spurting member. Consequently, the electrostatic coating machine can accelerate the paint particles while gradually orienting a direction of the paint particles to the coating object. In addition, when the external electrode member causes the sprayed paint particles to be electrified to be in the negative polarity by each of the electrodes, the paint particles are caused to fly along an electrostatic field formed between the coating object having an electric potential which is maintained at the ground level and the external electrode member to enhance a coating efficiency.

However, immediately after the paint (paint liquid thread) is separated from the releasing edge of the rotary atomizing head to become paint particles, the shaping air has a little impulse on the paint particles. Therefore, an axial kinetic vector component toward the coating object is small, and a primary kinetic vector component is a radially outward kinetic vector component. The axial kinetic vector component can be acquired by an action of the shaping air. However, since the shaping air is spurted from the limited number of holes arranged in a circular pattern, pressures of the shaping air are not uniform. The atomized paint particles vary in diameter dimension and in mass. Therefore, since the particles differ in air resistance and in inertia, the axial kinetic vector component cannot be constant.

When the paint particles are electrified to be in the negative polarity by corona discharge, a coulomb force, with which the paint particle is likely to be adsorbed to the shaping air spurting member and the rotary atomizing head having the same ground potential as that of the coating object, acts on the paint particles. On the other hand, the shaping air is caused to act on the paint particles. However, when the axial kinetic vector component cannot be acquired enough for counteracting the coulomb force by the shaping air, the paint particles return back to the coating machine direction. As a result, the returned paint particles adhere to the coating machine.

Accordingly, in the electrostatic coating machine disclosed in Patent Document 1, since a washing work is required quite frequently for preventing electrical shortcut due to the adhered paint particles, the productivity is worsened. Particularly, in a case of performing the coating in a narrow place as the vehicle compartment, there occurs a problem that the paint is more likely to adhere.

The present invention is made in view of the foregoing problems in the conventional technology, and an object of the present invention is to provide an electrostatic coating machine that can suppress adhesion of paint to a rotary atomizing head and a shaping air spurting member.

The present invention provides an electrostatic coating machine comprising: an air motor having an electric potential which is maintained at a ground level and that rotates a rotational shaft with compressed air supplied; a rotary atomizing head that is provided on the front side of the rotational shaft and is composed of a tubular body having an electric potential which is maintained at the ground level to spray paint, which is supplied while being rotated by the air motor, from a releasing edge in a front end; an external electrode member that is positioned in back of the rotary atomizing head and is provided on an outer peripheral side of the air motor to electrify paint particles sprayed from the releasing edge in the rotary atomizing head to be in a negative potential by applying a negative high voltage to a plurality of electrodes; and a shaping air spurting member that is formed in a tubular shape by using a conductive material and is arranged on an outer peripheral side of the rotary atomizing head in a state where a front end is positioned in an intermediate section of the rotary atomizing head in a length direction, the front end being provided with a plurality of air spurting holes over an entire circumference in a circumferential direction to spurt shaping air toward paint particles sprayed from the rotary atomizing head, characterized in that: a shield member is provided on an outer peripheral side of a front side section of the shaping air spurting member and is formed of an annular body radially extending to shield electric flux lines traveling toward the rotary atomizing head from each of the electrodes in the external electrode member; a tubular insulating member formed of an insulating material covering an outer peripheral surface of the shaping air spurting member is provided on an outer peripheral side of the shaping air spurting member; and a discharge buffering member of an annular self-returning insulator or semi-conductive material is provided in a position where the shield member is separated from the insulating member between the shield member and the insulating member.

According to the present invention, the adhesion of the paint onto the rotary atomizing head and the shaping air spurting member can be suppressed by flying the paint particles sprayed from the rotary atomizing head toward the coating object.

MODE FOR CARRYING OUT THE INVENTION

Hereinafter, an explanation will be in detail made of a rotary atomizing head type electrostatic coating machine of an indirect electrifying system according to embodiments of the present invention with reference to the accompanying drawings.

FIG. 1 to FIG. 6 show a first embodiment in the present invention. The first embodiment will be explained by taking a rotary atomizing head type electrostatic coating machine that is provided with a flange-shaped (disk-shaped) shield member extending in a straight line from an outer peripheral side of a front side portion of a shaping air spurting member to a radial outside, as an example. It should be noted that in the present embodiment, an arrangement relation in the later-mentioned rotary atomizing head type electrostatic coating machine 1 will be described such that a direction closer to a coating object 17 (or spurting direction of shaping air) is defined as a front side and a direction separate from the coating object 17 at the opposite to the front side is defined as a rear side.

Figure 1:
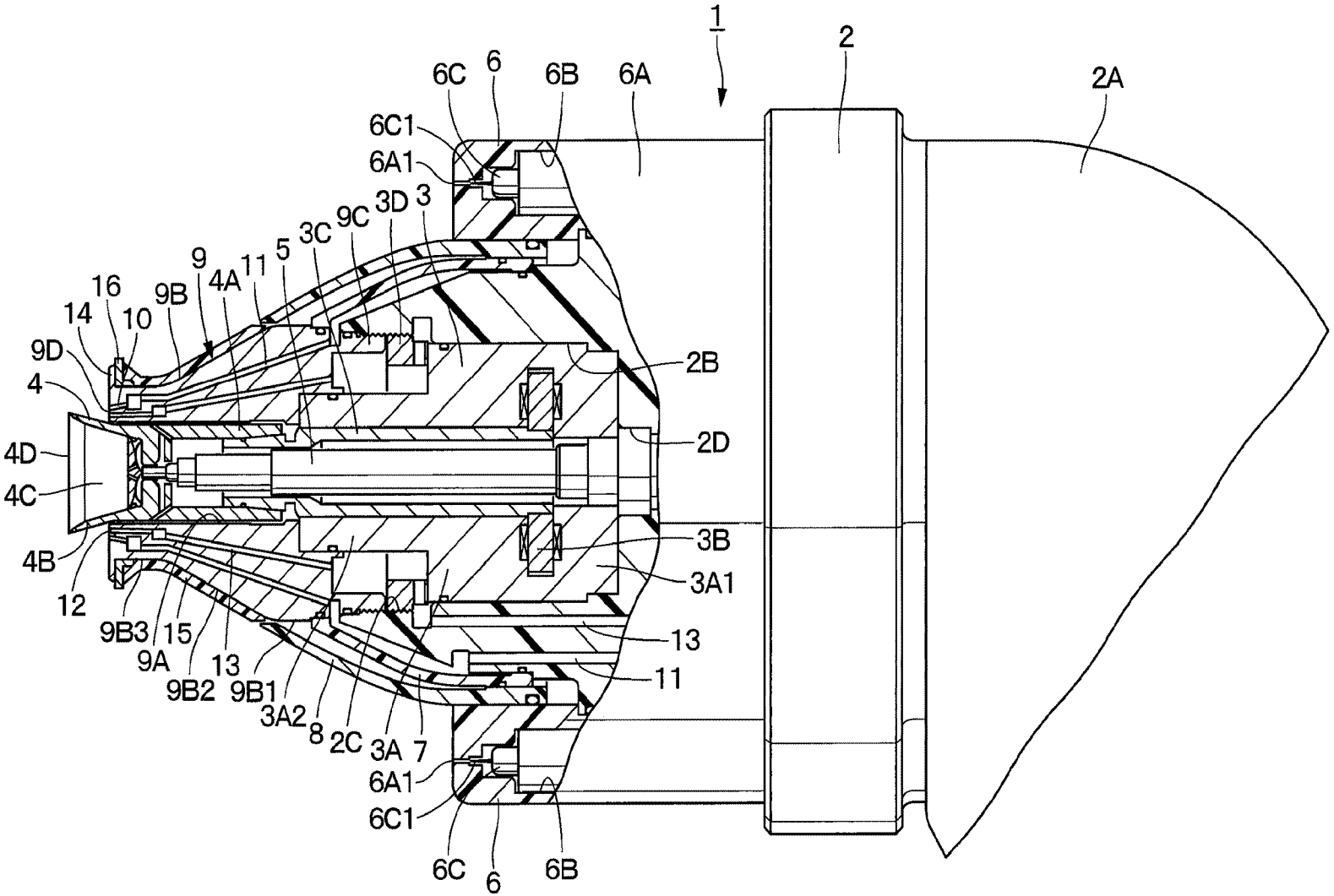
FIG. 1 is a cross sectional view showing a rotary atomizing head type electrostatic coating machine of an indirect electrifying system according to a first embodiment in the present invention.

In FIG. 1, the rotary atomizing head type electrostatic coating machine 1 (hereinafter, simply referred to as electrostatic coating machine 1) according to the first embodiment is configured as a rotary atomizing head type electrostatic coating machine of an indirect electrifying system that indirectly electrifies paint sprayed from a rotary atomizing head 4 by a later-mentioned external electrode member 6 to be at a high voltage. The electrostatic coating machine 1 is attached to a front end of an arm (not shown) in a coating robot, for example.

A coating machine support body 2 surrounds an air motor 3 as described later on an outer peripheral side of the air motor 3, and is provided to extend backward of the air motor 3. The coating machine support body 2 is mounted on a front end of the above-mentioned arm through a mounting tubular part 2A in a base end side. Here, the coating machine support body 2 is made of an insulating plastic material having rigidity, for example.

A motor accommodating part 2B is provided on a front end side of the coating machine support body 2 to open forward, and a female screw part 2C is provided on an open side of the motor accommodating part 2B. Further, the coating machine support body 2 is provided with an insertion hole 2D in a central position (coaxially with a later-mentioned rotational shaft 3C) of a bottom portion in the motor accommodating part 2B to insert a base end side of a later-mentioned feed tube 5.

The air motor 3 is provided in the motor accommodating part 2B in the coating machine support body 2. The air motor 3 rotates the rotational shaft 3C and the rotary atomizing head 4 described later at high speeds, for example, 3000 rpm to 150000 rpm using compressed air as a power source. The air motor 3 is made of a conductive metallic material containing an aluminum alloy, for example, and an electric potential thereof is maintained at the ground level.

The air motor 3 includes a motor case 3A in a stepped cylindrical shape that is mounted on a front side of the coating machine support body 2, a turbine 3B, for example, in an impeller type to be positioned closer to a rear side of the motor case 3A and be rotatably accommodated, and the rotational shaft 3C that is rotatably provided in a center position of the motor case 3A and has a rear end side which is mounted to the turbine 3B.

The motor case 3A of the air motor 3 is formed as a cylindrical body coaxial with the rotational shaft 3C. The motor case 3A is formed in a stepped cylindrical shape with a large diameter cylinder 3A1 that is inserted in the motor accommodating part 2B of the coating machine support body 2, and a small diameter cylinder 3A2 that projects forward from the large diameter cylinder 3A1.

The motor case 3A is inserted and fitted in the motor accommodating part 2B of the coating machine support body 2. In this state, the motor case 3A is fixed in the motor accommodating part 2B by an annular screw member 3D that is threaded in the female screw part 2C of the coating machine support body 2.

The rotational shaft 3C is formed as a hollow, tubular body that is rotatably supported through an air bearing (not shown) in the motor case 3A. The rotational shaft 3C has a rear end side that is mounted in the center of the turbine 3B, and a front end side that projects in front from the motor case 3A. The rotary atomizing head 4 is mounted on a front end part of the rotational shaft 3C using a screw means, for example.

Figure 3:
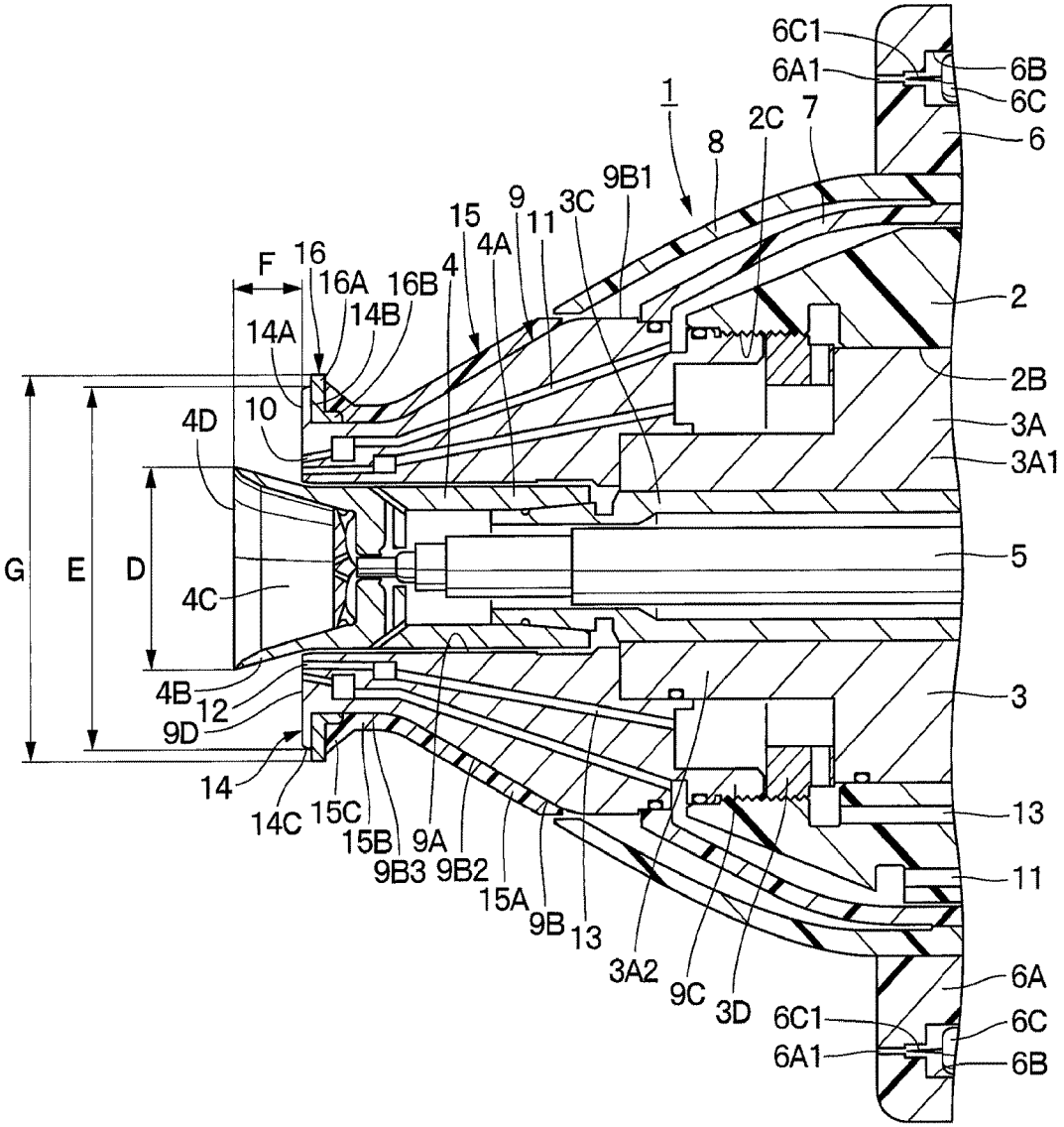
FIG. 3 is an enlarged cross sectional view showing a front side portion of the rotary atomizing head type electrostatic coating machine.

The rotary atomizing head 4 is provided in the front side of the rotational shaft 3C in the air motor 3. The rotary atomizing head 4 is formed as a tubular body by a conductive metallic material, such as an aluminum alloy, and an electric potential thereof is maintained at the ground level through the air motor 3. As shown in FIG. 3, the rotary atomizing head 4 is formed as an elongated tubular body, for example, and has a rear side that is formed as an axially and linearly extending mounting section 4A. The mounting section 4A is mounted on a front end part of the rotational shaft 3C using a screw means, for example.

The front side of the rotary atomizing head 4 is formed as a flare section 4B that opens to gradually widen toward the front side. An inner peripheral surface of the flare section 4B is formed as a paint spreading surface 4C for causing the supplied paint to forma film surface. Further, a tip end (front end) of the paint spreading surface 4C is formed as a releasing edge 4D that releases the film-shaped paint as paint particles. Here, the rotary atomizing head 4 is set to have a maximum diameter dimension, that is, a diameter of the releasing edge 4D is set to a dimension D (refer to FIG. 3).

In addition, in a state where the rotary atomizing head 4 is rotated at high speeds by the air motor 3, when paint is supplied to the rotary atomizing head 4 through a later-mentioned feed tube 5, the paint is sprayed from the releasing edge 4D by centrifugal forces while being formed as a thin film on the paint spreading surface 4C. In this case, the paint particles sprayed from the releasing edge 4D do not travel toward the later-mentioned coating object 17 arranged in front and are likely to fly toward a radial outward (radiate outward) by centrifugal forces of the rotary atomizing head 4.

However, the paint particles sprayed from the releasing edge 4D are accelerated to gradually travel toward the coating object 17 in front side with shaping air sprayed by a later-mentioned shaping air spurting member 9 from the rear side. Further, the paint particles sprayed from the releasing edge 4D are electrified to be in a negative polarity by a later-mentioned external electrode member 6, thereby making it possible to fly along an electrostatic field formed between the releasing edge 4D and the coating object 17 having an electric potential which is maintained at the ground level.

The feed tube 5 is provided to be inserted in the rotational shaft 3C, and a rear end side thereof is inserted and fitted in the insertion hole 2D of the coating machine support body 2 (refer to FIG. 1). On the other hand, a front end side of the feed tube 5 projects from the rotational shaft 3C and extends into the rotary atomizing head 4. A paint passage is formed in the inside of the feed tube 5, and the paint passage is connected to a paint supply source and a washing fluid supply source (none of them is shown) through a color changing valve apparatus. Accordingly, the feed tube 5 supplies the paint from the paint supply source to the rotary atomizing head 4 through the paint passage at coating, and supplies washing fluid (thinner, air or the like) from the washing fluid supply source at washing, color changing and the like.

The external electrode member 6 is positioned closer to the rear side than the rotary atomizing head 4 and is provided on an outer peripheral side of the air motor 3, that is, on an outer peripheral side of the coating machine support body 2. The external electrode member 6, by applying a negative high voltage (for example, −30~−150 kV) to a plurality of electrodes 6C as described later, electrifies the paint particulates sprayed from the releasing edge 4D of the rotary atomizing head 4 to be in the negative potential.

The external electrode member 6 includes an annular external electrode support tubular body 6A that is made of an insulating plastic material and is provided on an outer peripheral side of the coating machine support body 2, a plurality (8 to 20, for example) of electrode mounting holes 6B (only two ones are shown) that are arranged on the external electrode support tubular body 6A in a circumferential direction by equal intervals, and electrodes 6C that are mounted on the respective electrode mounting holes 6B. Holes 6A1 in number corresponding to needle parts 6C1 of the respective electrodes 6C are provided in the front side of the external electrode support tubular body 6A.

Here, the external electrode member 6 according to the first embodiment is provided in a position closer to the rear side of the coating machine support body 2 and near the outer peripheral side of the coating machine support body 2 for using the electrostatic coating machine 1 in a narrow space as in the inside of a vehicle body. As a result of this arrangement, the needle part 6C1 of each of the electrodes 6C is arranged in a position largely separated from the rotary atomizing head 4 in an axial rear side, that is, on an outer peripheral side of the air motor 3. Further, the needle part 6C1 of each of the electrodes 6C is arranged in a position near a radial outside of an outer cover member 8 as described later. Accordingly, at a coating work time, each of the electrodes 6C can be suppressed from interfering with circumferential members.

The respective electrodes 6C are connected to a high-voltage generator through resistances (none of them is shown). Accordingly, a negative high voltage is applied to each of the electrodes 6C by the high voltage generator. Therefore, the external electrode member 6 electrifies paint particles sprayed from the rotary atomizing head 4 to be in the negative polarity due to generation of corona discharge in each of the electrodes 6C.

An inner cover member 7 is formed as a tubular body that is reduced in diameter in an arc shape toward the front side by using an insulating plastic material, for example. The inner cover member 7 is provided between the external electrode member 6 and a shaping air spurting member 9 as described later in such a manner as to surround the air motor 3. The inner cover member 7 has a rear side that is mounted to an outer peripheral side of the coating machine support body 2. On the other hand, the inner cover member 7 has a front side that is mounted to a rear part of a large diameter cylindrical section 9B1 configuring an outer peripheral surface 9B of the shaping air spurting member 9.

The outer cover member 8, in the same way as the inner cover member 7, is formed as a tubular body that is reduced in diameter in an arc shape toward the front side, by an insulating plastic material. The outer cover member 8 is provided between the external electrode member 6 and the shaping air spurting member 9 in such a manner as to surround the air motor 3 in a position closer to the outside than the inner cover member 7.

The outer cover member 8 has a rear side that is mounted between the inner cover member 7 and an inner peripheral side of the external electrode member 6. The outer cover member 8 has a front side that is disposed in an intermediate section of the outer peripheral surface 9B of the shaping air spurting member 9 in the front-rear direction. The outer cover member 8 can be removed at the assembly work or the disassembly work of the rotary atomizing head 4, the shaping air spurting member 9 and the like.

The shaping air spurting member 9 is disposed on the outer peripheral side of the rotary atomizing head 4 in a state where the front end of the shaping air spurting member 9 is positioned in an intermediate section (in back of the flare section 4B) of the rotary atomizing head 4 in the length direction. The shaping air spurting member 9 is formed of a conductive metallic material containing an aluminum alloy, for example, and an electric potential thereof is maintained at the ground level through the air motor 3.

The shaping air spurting member 9 is formed as a stepped cylindrical body that surrounds the rotary atomizing head 4. An inner peripheral surface 9A of the shaping air spurting member 9 faces the outer peripheral surface of the rotary atomizing head 4 to have a slight clearance therebetween. On the other hand, the outer peripheral surface 9B of the shaping air spurting member 9 formed of a large diameter cylindrical section 9B1 with a large diameter positioned in a rear side, a tapered section 9B2 gradually reducing in diameter toward the front side from a front end of the large diameter cylindrical section 9B1 and a small diameter cylindrical section 9B3 linearly extending toward the front side from a front end of the tapered section 9B2.

A front side section of the inner cover member 7 is mounted on a rear part of the large diameter cylindrical section 9B1 in a state of being fitted thereupon. The tapered section 9B2 and the small diameter cylindrical section 9B3 are covered with an insulating member 15 to be described later.

A rear end section of the shaping air spurting member 9 is formed as a cylindrical mounting screw part 9C, and the mounting screw part 9C is threaded into the female screw part 2C of the coating machine support body 2. Thereby, the shaping air spurting member 9 is mounted on the front side section of the coating machine support body 2 using the mounting screw part 9C.

Figure 2:
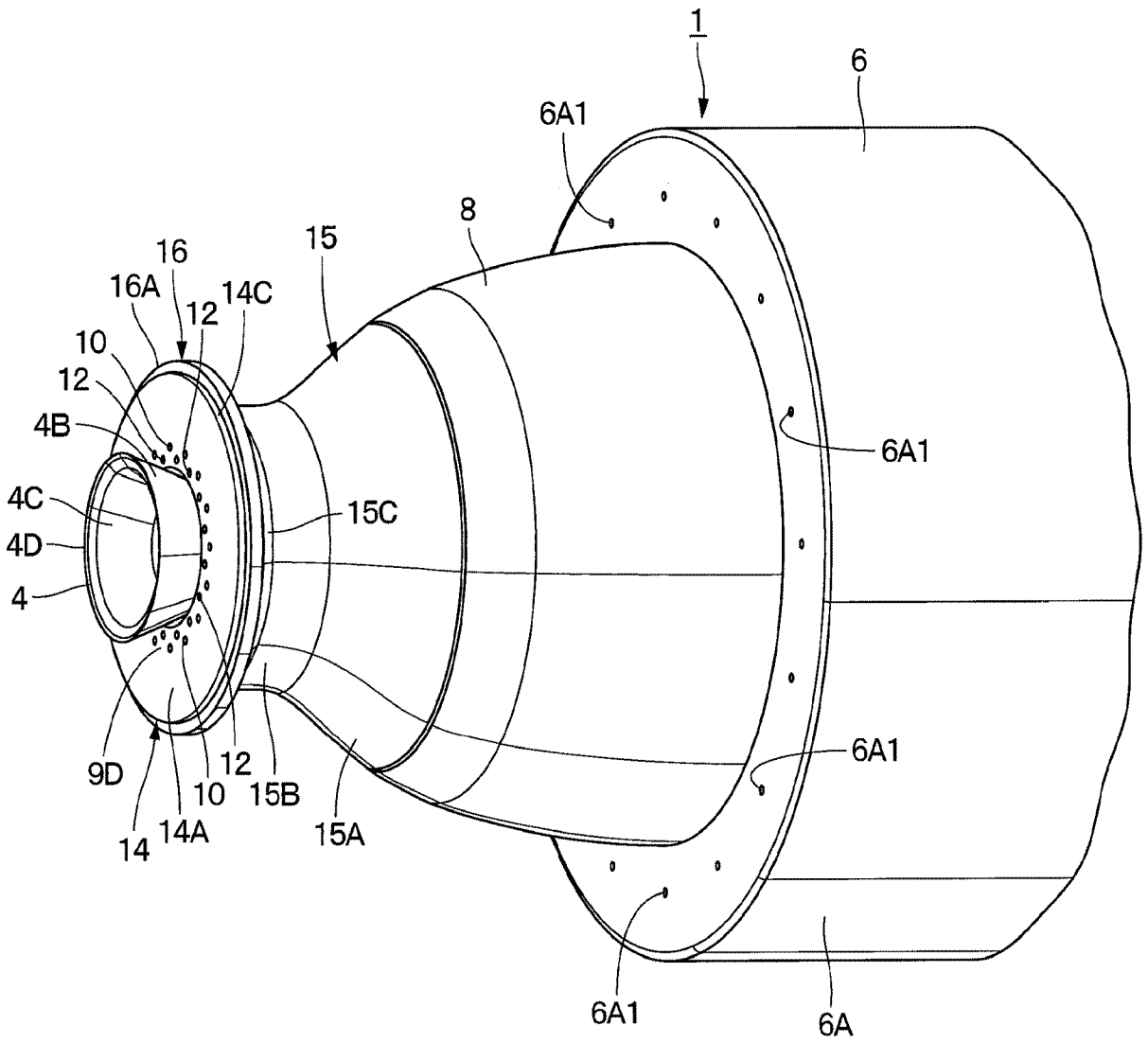
FIG. 2 is a perspective view showing the rotary atomizing head type electrostatic coating machine of the indirect electrifying system.
Figure 4:
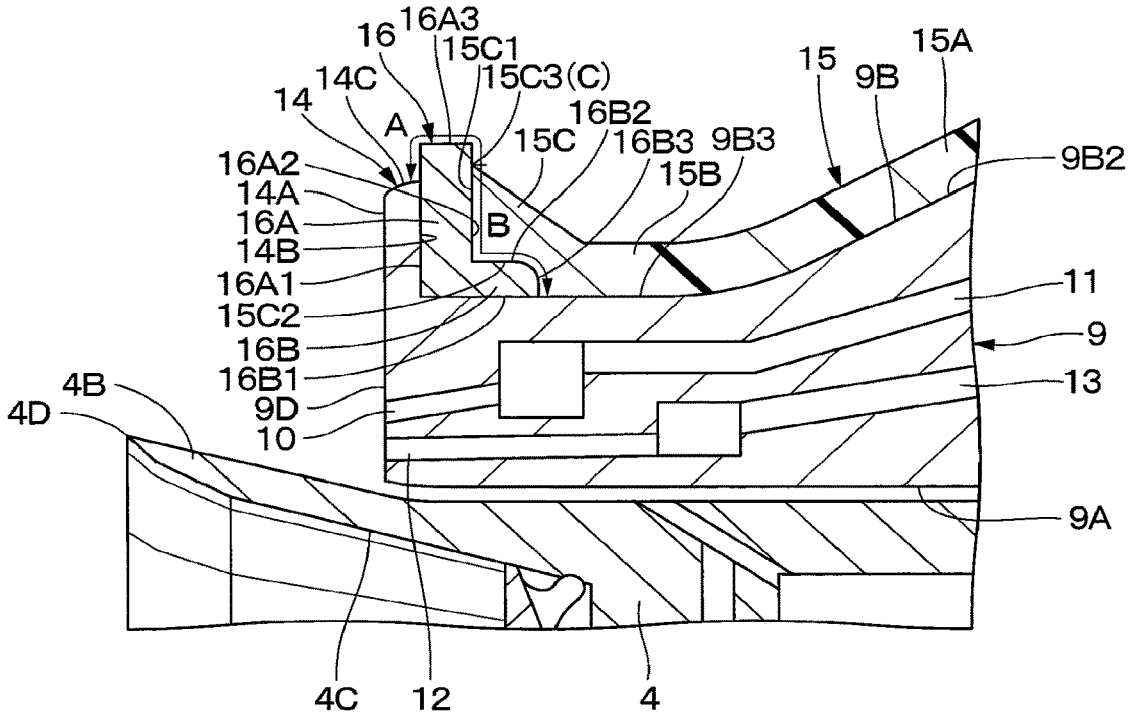
FIG. 4 is an enlarged cross sectional view showing a shield member, an insulating member, a discharge buffering member and the like in FIG. 3.

Further, as shown in FIG. 2 to FIG. 4, the front end (front side section) of the shaping air spurting member 9 is formed as the flat annular front surface section 9D. The front surface section 9D is provided with first air spurting holes 10 and second air spurting holes 12 that open to an exterior. The front surface section 9D is arranged around a rear part position of the flare section 4B in the rotary atomizing head 4.

The first air spurting holes 10 comprise many pieces of the holes that are positioned closer to an outer diameter side of the front surface section 9D to be arranged over an entire circumference in a circumferential direction by equal intervals. The first air spurting holes 10 are connected to a first shaping air supply source (not shown) through first shaping air passages 11. The first air spurting holes 10 spurt first shaping air toward the vicinity of the releasing edge 4D in the rotary atomizing head 4.

The second air spurting holes 12 comprise a plurality of the holes that are positioned closer to a radial inside than the first air spurting holes 10 to be arranged in the front surface section 9D over an entire circumference in a circumferential direction by equal intervals. The second air spurting holes 12 are connected to a second shaping air supply source (not shown) through second shaping air passages 13. The second air spurting holes 12 spurt second shaping air toward the backside in the rotary atomizing head 4.

As a result, the first shaping air spurted from the first air spurting holes 10 and the second shaping air spurted from the second air spurting holes 12 shear liquid threads of paint released from the releasing edge 4D of the rotary atomizing head 4 to speed up formation of paint particles and adjust the shape of a spray pattern of paint particles sprayed from the rotary atomizing head 4. At this time, a pressure of the first shaping air and a pressure of the second shaping air are adjusted as needed, thus making it possible to change the spray pattern to a desired size and shape. Further, the first and second shaping air are sprayed on the paint particles flying toward the radial outside from the releasing edge 4D of the rotary atomizing head 4 by centrifugal forces to accelerate the paint particles while causing the paint particles to be gradually oriented to a coating object.

Next, an explanation will be in detail made of the configuration of each of the shield member 14, the insulating member 15 and discharge buffering member 16 that are characteristic parts in the first embodiment.

The shield member 14 is positioned in the outer peripheral side of the front surface section 9D in the shaping air spurting member 9 and is formed as the annular body extending radially. The shield member 14 shields electric flux lines traveling toward the rotary atomizing head 4 from the respective electrodes 6C in the external electrode member 6. The shield member 14 is formed as an annular member, for example, a flange-shaped plate body that extends in the outer peripheral side of the shaping air spurting member 9, that is, in the radial outward from the front part position of the small diameter cylindrical section 9B3 of the outer peripheral surface 9B.

The shield member 14 is formed to be integral with the shaping air spurting member 9. Thereby, an electric potential of the shield member 14 is maintained at the ground level through the shaping air spurting member 9 or the like.

As shown in FIG. 3 and FIG. 4, the shield member 14 includes a front surface part 14A that is flush with the front surface section 9D in the shaping air spurting member 9, a rear surface part 14B that is positioned at the opposite to the front surface part 14A in a front-rear direction, and a peripheral edge part 14C that is an outermost peripheral part of the front surface part 14A and the rear surface part 14B.

Here, an explanation will be made of a size and an arrangement position of the shield member 14. First, a diameter dimension E of the shield member 14 (refer to FIG. 3) is set according to the following Formula 1 in relation to a diameter dimension D of the releasing edge 4D of the rotary atomizing head 4.

$$1.4D \leq E \leq 3.0D, \quad \text{[Formula 1]}$$

Preferably, $$1.5D \leq E \leq 2.5D$$

Accordingly, the paint particles are sufficiently accelerated toward the coating object 17 by the shaping air spurted from the shaping air spurting member 9. The shield member 14 can adjust electric flux lines by each of the electrodes 6C of the external electrode member 6 in such a manner that the sufficiently accelerated paint particles are exposed and electrified to a high voltage.

Further, an axial arrangement position of the shield member 14, that is, a backward distance dimension F from the releasing edge 4D of the rotary atomizing head 4 to the front surface part 14A of the shield member 14 is set according to the following Formula 2.

$$1\ \text{mm} \leq F \leq 50\ \text{mm} \quad \text{[Formula 2]}$$

In this case, by arranging the shield member 14 in a position near the releasing edge 4D of the rotary atomizing head 4, that is, by making the distance dimension F small, the diameter dimension E of the shield member 14 can be suppressed to be small. Thereby, since the shield member 14 can be formed in a compact manner, the coating can be performed without interfering with surrounding members even in a narrow place as the inside of the vehicle body. Therefore, it is desirable that the distance dimension F between the rotary atomizing head 4 and the shield member 14 is set to be small.

On the other hand, the washing performance of the paint adhered to the shield member 14 can be enhanced by making a difference in level between the front surface part 14A and the front surface section 9D of the shaping air spurting member 9 small (or eliminating the difference). Further, the shield member 14 is formed, for example, in a position of shielding a straight line that connects the needle part 6C1 of each of the electrodes 6C in the external electrode member 6 and the releasing edge 4D of the rotary atomizing head 4.

The insulating member 15 is provided on the outer peripheral side of the shaping air spurting member 9. The insulating member 15 covers the tapered section 9B2 of the outer peripheral surface 9B of the shaping air spurting member 9 and the outer peripheral side of the small diameter cylindrical section 9B3 and is formed as a tubular body made of a highly insulating material (for example, a volumetric efficiency thereof is $10^{16}$~$10^{18}$ Ωcm), such as tetrafluoroethylene resin. The insulating member 15 may be formed by a highly insulating material other than tetrafluoroethylene resin.

Here, the surface of the insulating member 15 is electrified when electrified ion particles generated by the needle part 6C1 (corona discharge electrode) of the electrode 6C move along the electric flux lines extending toward the shaping air spurting member 9. The electrified insulating member 15 changes an electric field in the surroundings and transitions the electric flux lines extending from the needle part 6C1 (corona discharge electrode) to the shield member 14-side to create a state where the paint particles are more likely to be electrified. In addition, the electrified insulating member 15, in a case where the paint particles electrified in homo-polarity approach it without an intent, generates an electrical repulsion force to prevent adhesion of the paint particles, thus reducing the contamination.

The insulating member 15 is formed of a tapered cover part 15A that is positioned in the rear side to cover the outer peripheral side of the tapered section 9B2, a tubular cover part 15B extending to the front side to cover the outer peripheral side of the small diameter cylindrical section 9B3 from a small diameter front part of the tapered cover part 15A and an enlarged diameter part 15C extending to a radial outward from the front end of the tubular cover part 15B. A front surface 15C1 of the enlarged diameter part 15C abuts on a rear surface 16A2 of a disc part 16A of a discharge buffering member 16 to be described later to make close contact therewith. A fitting part 15C2 in which a cylindrical part 16B of the discharge buffering member 16 to be described later is fitted is formed in an inner diameter side of the enlarged diameter part 15C. Further, the outer peripheral section 15C3 of the enlarged diameter part 15C functions as a base point C (refer to FIG. 4) to a discharge line A and a discharge line B to be described later.

The discharge buffering member 16 is disposed between the shield member 14 and the insulating member 15. Specifically, the discharge buffering member 16 is disposed between the rear surface part 14B of the shield member 14 and the front surface 15C1 of the enlarged diameter part 15C of the insulating member 15. The discharge buffering member 16 is formed annually in a position of separating the shield member 14 from the insulating member 15.

The discharge buffering member 16 is made of an insulating material and is formed using a self-returning insulator, such as ceramic. Therefore, in a case where electrical charge intermittently moves from the electrified insulating member 15 toward the shaping air spurting member 9 earthed to the ground (that is, partially discharged), the discharge generates through the discharge buffering member 16.

The discharge buffering member 16 may be formed using a self-returning insulator, such as glass, mica or alumina, other than ceramic. The discharge buffering member 16 made of ceramic has porous properties. The discharge buffering member 16 causes water components in air to remain on the surface using a porous structure to reduce an apparent specific resistance and mildly perform the transition of the electrical charge, thus making it possible to mitigate electrical stress.

On the other hand, in a case where the discharge buffering member 16 is formed of a semiconductor material (for example, a volumetric efficiency is $10^{2}$~$10^{8}$ Ωcm), since the transition of the electrical charge is mildly performed, even this method can suppress degradation of the insulator. PTFE (tetrafluoroethylene) containing carbons or oxidized metal, PP (polypropylene), PEEK (polyether ketone) and the like may be applied as semiconductor materials.

Figure 5:
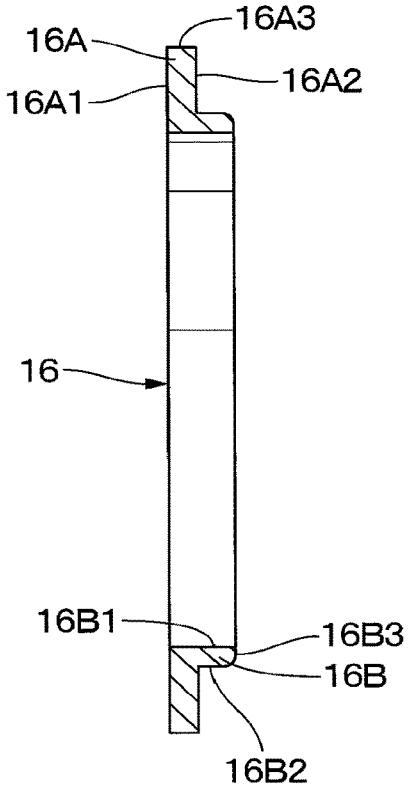
FIG. 5 is a cross sectional view showing the discharge buffering member as a single unit.

As shown in FIG. 4 and FIG. 5, the discharge buffering member 16 is formed as a stepped annular body having an L-letter shape in section by a disc part 16A formed of an annular plate body facing the rear surface part 14B of shield member 14 and a cylindrical part 16B extending to the opposite side (rear side) of the shield member 14 from the inner diameter side of the disc part 16A. The disc part 16A has a diameter dimension G (refer to FIG. 3) larger than a diameter dimension E of the shield member 14. Accordingly, the disc part 16A of the discharge buffering member 16 is formed in a position of shielding a straight line connecting the needle part 6C1 of each of the electrodes 6C of the external electrode member 6 and the shield member 14. Consequently, the discharge buffering member 16 can cause the electrified amount of the shield member 14 to decay in cooperation with the enlarged diameter part 15C of the insulating member 15. In addition, the cylindrical part 16B of the discharge buffering member 16 is mounted on the small diameter cylindrical section 9B3 of the outer peripheral surface 9B of the shaping air spurting member 9 in a state of being fitted thereon.

The disc part 16A has a front surface 16A1, a rear surface 16A2 and an outer peripheral surface 16A3. The front surface 16A1 abuts on the rear surface part 14B of the shield member 14 to make close contact therewith. The rear surface 16A2 abuts on the front surface 15C1 of the enlarged diameter part 15C of the insulating member 15 to make close contact therewith. On the other hand, the cylindrical part 16B has an inner peripheral surface 16B1, an outer peripheral surface 16B2 and a rear surface 16B3. The inner peripheral surface 16B1 is fitted on the small diameter cylindrical section 9B3 of the outer peripheral surface 9B of the shaping air spurting member 9 from outside, and the outer peripheral surface 16B2 and the rear surface 16B3 are fitted in and abut on the fitting part 15C2 of the enlarged diameter part 15C.

Here, the discharge buffering member 16 is formed by ceramic having porous properties. Therefore, the discharge buffering member 16 can cause water components and the like to remain on the surface by using the porous properties. Particularly, since high humidity is kept in the inside of a coating booth for coating, water components and the like are likely to remain on the surface. The discharge buffering member 16 uses the water components remaining on the surface, thus making it possible to be minutely electrified or have the flow of electrical current on the surface. Consequently, the electric charge electrified to the insulating member 15 gradually flows through the water components on the surface of the discharge buffering member 16 and can reach the shield member 14.

In this case, the electric charge electrified to the insulating member 15 is caused to gradually flow to the shield member 14 through the surface of the discharge buffering member 16, thus making it possible to suppress the discharge between the insulating member 15 and the shield member 14. Even when the discharge between the insulating member 15 and the shield member 14 generates on this condition, since the discharge buffering member 16 disposed therebetween is formed of ceramic excellent in rigidity, thermal resistance and the like, there occurs no electric degradation due to the discharge.

Descriptions will be made of the structure of causing the electric charge electrified to the insulating member 15 to reach the shield member 14 through the surface of the discharge buffering member 16 with reference to FIG. 4.

In this case, the line in which the electric charge electrified to the surface of the insulating member 15 flows is a discharge line A that has a base point C as the outer peripheral section 15C3 of the enlarged diameter part 15C and leads through the rear surface 16A2, the outer peripheral surface 16A3 and the front surface 16A1 of the disc part 16A of the discharge buffering member 16 to a peripheral edge part 14C of the shield member 14. In addition, the line is a discharge line B that leads from the base point C through the rear surface 16A2 of the disc part 16A, the outer peripheral surface 16B2 and the rear surface 16B3 of the cylindrical part 16B of the discharge buffering member 16 to the outer peripheral surface 9B of the shaping air spurting member 9.

The discharge line B can be formed to be elongated by providing the cylindrical part 16B in the inner diameter side of the disc part 16A. In the present embodiment, a length dimension AL (creepage distance) of the discharge line A and a length dimension BL (creepage distance) of the discharge line B are set according to the following Formula 3.

$$BL > AL, \text{ preferably } BL > 1.5AL \qquad \text{[Formula 3]}$$

Consequently, it is possible to cause the electric charge electrifies to the insulating member 15 to flow through the discharge line A short in creepage distance to the shield member 14. Further, since the discharge line B is bent in an L-letter shape, the electric charge can be made more difficult to flow as compared to a flat surface. Also, in this point, it is possible to prevent the electric charge electrified to the insulating member 15 from flowing to the shaping air spurting member 9.

Next, an explanation will be made of an operation in a case of performing the coating on the coating object 17 by the electrostatic coating machine 1.

First, a coating work by the electrostatic coating machine 101 according to the conventional technology as a comparative example will be described with reference to FIG. 10. The electrostatic coating machine 101 is configured in the same way as the electrostatic coating machine 1 according to the first embodiment except for a point where the shield member 14, the insulating member 15 and the discharge buffering member 16 are not provided.

Turbine air is supplied to the turbine 3B of the air motor 3 to rotate the rotational shaft 3C. Accordingly, the rotary atomizing head 4 rotates at high speeds together with the rotational shaft 3C. The paint selected in the color changing valve device (not shown) is supplied to the rotary atomizing head 4 through the paint passage in the feed tube 5 in this state. The paint can be sprayed as paint particles from the releasing edge 4D by centrifugal forces while being formed as a thin film on the paint spreading surface 4C of the rotary atomizing head 4.

Figure 10:
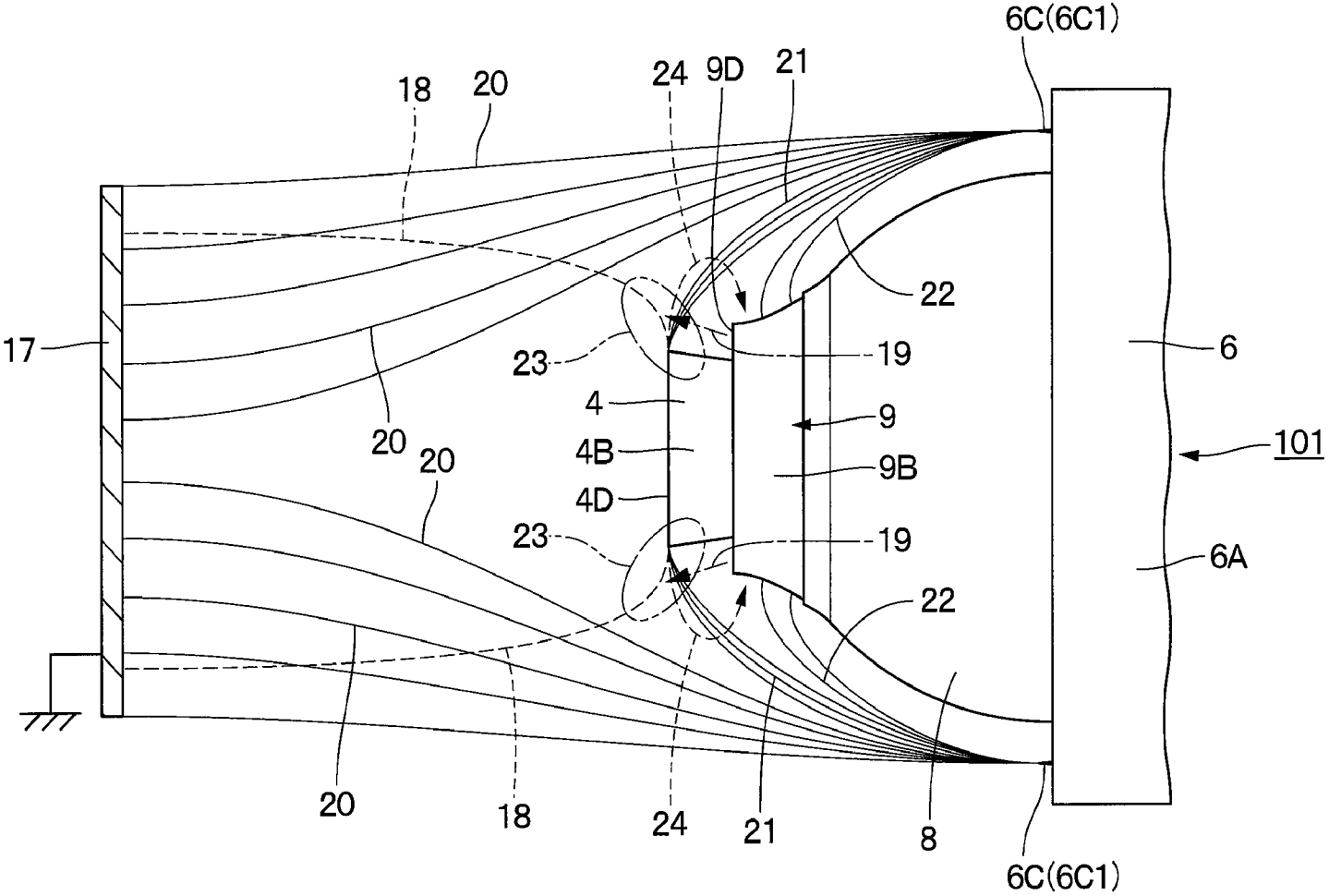
FIG. 10 is an explanatory diagram schematically showing a relation between paint particles, shaping air, electric flux lines and the like according to a comparative example.

In this case, as shown in a dotted line 18 in FIG. 10, immediately after the paint particles are separated from the releasing edge 4D of the rotary atomizing head 4, the paint particles do not travel toward the coating object 17 arranged forward and are likely to fly toward a radial outward in a radial fashion by centrifugal forces of the rotary atomizing head 4. Therefore, as shown in an arrow 19 in a dashed-dotted chain line in FIG. 10, the shaping air spurting member 9 sprays the shaping air toward the paint particles from the respective air spurting holes 10, 12. Thereby, the shaping air spurting member 9 causes the paint particles to be gradually oriented toward the coating object 17 in front by its forward driving force and to be accelerated. In addition, the shaping air can adjust the shape of the spray pattern of the paint particles while atomizing the paint particles.

When paint particles are sprayed from the releasing edge 4D of the rotary atomizing head 4, a negative high voltage by a high-voltage generator is applied to each of the electrodes 6C in the external electrode member 6. Each of the electrodes 6C forms electric flux lines 20 between each of the electrodes 6C and the coating object 17 having an electric potential which is maintained at the ground level and electrifies the paint particles sprayed from the releasing edge 4D to be in the negative polarity. As a result, the paint particles are caused to travel along the electric flux lines 20, thereby making it possible to be efficiently supplied to the coating object 17.

However, an electric potential of both the rotary atomizing head 4 and the shaping air spurting member 9 is also maintained at the ground level. Therefore, electric flux lines 21 are formed between each of the electrodes 6C and the front end (releasing edge 4D) of the rotary atomizing head 4, and electric flux lines 22 are formed also between each of the electrodes 6C and the outer peripheral surface 9B of the shaping air spurting member 9.

Here, since the electric flux lines 21 traveling toward the rotary atomizing head 4 from each of the electrodes 6C concentrate on the releasing edge 4D of the rotary atomizing head 4, discharge (corona discharge) is generated in the releasing edge 4D as well in addition to the front end of each of the electrodes 6C. At this time, ion particles due to the discharge collide with paint particles in a front end position of the rotary atomizing head 4 to electrify the paint particles to be in the negative polarity (collision electrification). Therefore, the front end position of the rotary atomizing head 4 becomes an electrified area 23 (range surrounded in a two-dot chain line) where the paint particles are electrified to be in the negative polarity.

As a result, the paint particles, immediately after being separated from the releasing edge 4D of the rotary atomizing head 4, are electrified to be in the negative polarity. The paint particles, immediately after being separated therefrom, have weak forward driving forces by the shaping air, and have radial outward kinetic vector components. In addition, since the shaping air is spurted from a plurality of the air spurting holes 10, 12 arranged annually, it is difficult to acquire a uniform spurting pressure. Further, the atomized paint particles have variations in a diameter dimension and in weight. Therefore, the axial kinetic vector components do not become constant due to differences in air resistance and inertia of paint particles.

When the paint particles are electrified to be in the negative polarity in this state, paint particles having a particularly weak function of the shaping air out of the electrified paint particles are, as shown in a dotted line 24, pulled to the rotary atomizing head 4, the shaping air spurting member 9 and the like arranged near the external electrode member 6 by coulomb forces to adhere thereto and to contaminate them.

Figure 6:
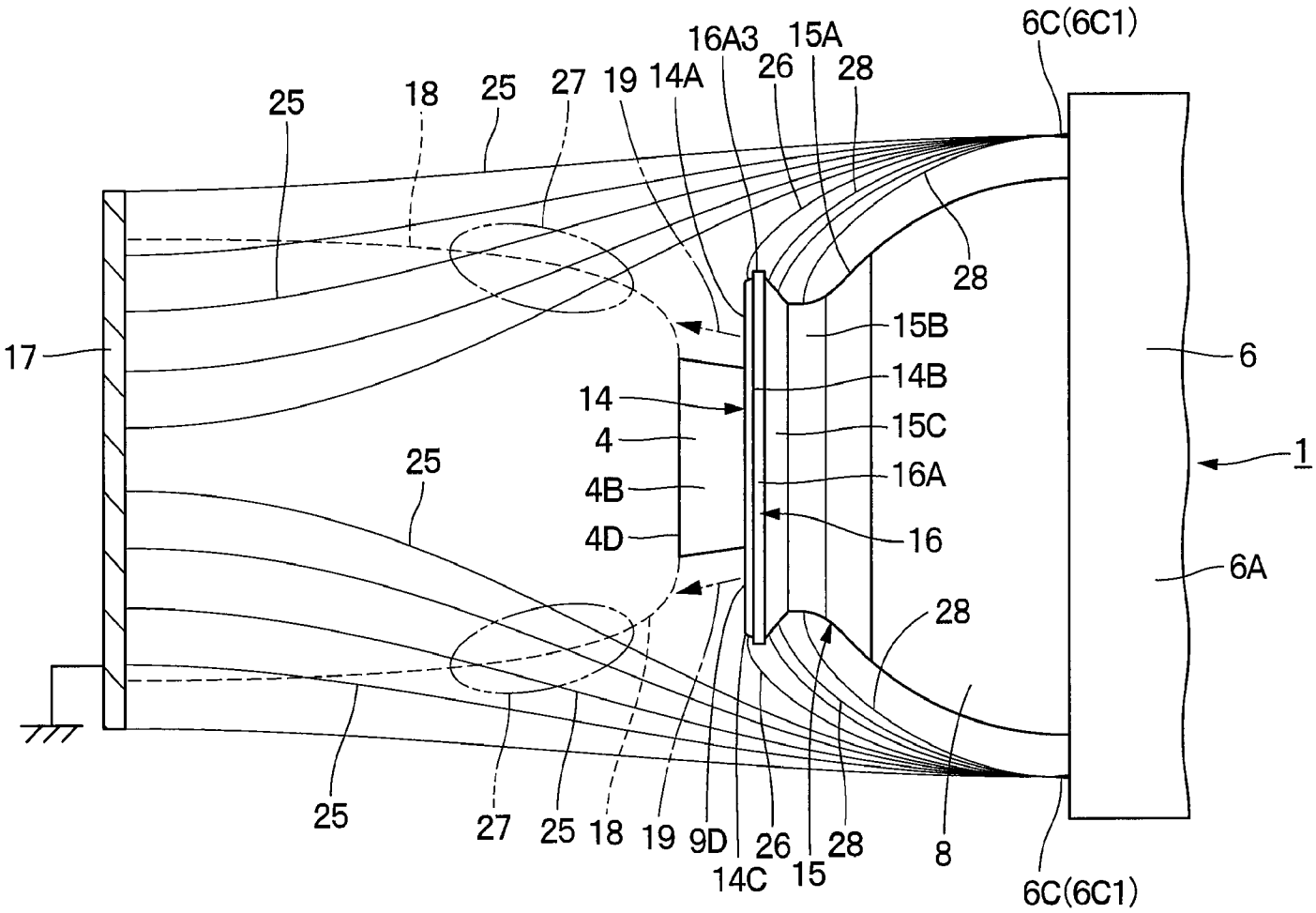
FIG. 6 is an explanatory diagram schematically showing a relation between paint particles, shaping air, electric flux lines and the like in a case of providing the shield member, the insulating member and the discharge buffering member.

Next, an explanation will be made of electric flux lines and a flying state of paint particles in a case of performing the coating by the electrostatic coating machine 1 provided with the shield member 14 with reference to FIG. 6.

When the paint particles are sprayed from the releasing edge 4D of the rotary atomizing head 4, each of the electrodes 6C of the external electrode member 6 forms electric flux lines 25 between each of the electrodes 6C and the coating object 17 having an electric potential which is maintained at the ground level. As a result, it is possible to efficiently supply the paint particles to the coating object 17 along the electric flux lines 25.

In this case, an electric potential of both the rotary atomizing head 4 and the shaping air spurting member 9 is also maintained at the ground level. However, the shield member 14 having the electric potential which is maintained at the ground level is provided between the rotary atomizing head 4 and each of the electrodes 6C. Accordingly, the electric flux lines traveling toward the releasing edge 4D of the rotary atomizing head 4 from each of the electrodes 6C in the external electrode member 6 can be shielded by the shield member 14. Specifically, by forming electric flux lines 26 between each of the electrodes 6C and the peripheral edge part 14C of the shield member 14, density of the electric flux lines between each of the electrodes 6C and the rotary atomizing head 4 can be made low.

The paint particles atomized by the rotary atomizing head 4 radially spread out from the shield member 14 by centrifugal forces and pass through a high electric field narrow in intervals between the electric flux lines. At this time, subjected to collision with air ion particles flying along the electric flux lines, the paint particles are electrified to be in the negative polarity. In addition, forces due to the shaping air also act on the paint particles.

Therefore, an electrified area 27 (range surrounded in a two-dot chain line) where the paint particles sprayed from the rotary atomizing head 4 are to be electrified to be in the negative polarity can be set to a position separated outward and forward from the releasing edge 4D of the rotary atomizing head 4. Accordingly, the paint particles sprayed from the releasing edge 4D of the rotary atomizing head 4 can accelerate toward the coating object 17 by the shaping air until reaching the electrified area 27. Thereby, in a case where the paint particles are electrified to be in the negative polarity in the electrified area 27, since the paint particles do not fly to the electrostatic coating machine 1-side, it is possible to improve a coating efficiency on the coating object 17 while preventing contamination of the electrostatic coating machine 1 due to the return of the paint particles.

In this way, according to the first embodiment, the shield member 14 formed of the annular body radially extending is provided on the outer diameter side of the front surface section 9D in the shaping air spurting member 9. As a result, the shield member 14 can shield the electric flux lines traveling toward the rotary atomizing head 4 from each of the electrodes 6C in the external electrode member 6. Thereby, since the paint particles are electrified after accelerating toward the coating object 17, it is possible to suppress the contamination of the shaping air spurting member 9 and the like due to the returned paint.

As a result, since it is possible to reduce frequency of performing the washing work on the adhered paint by providing the shield member 14, it is possible to improve the productivity in a case of performing the coating work using the electrostatic coating machine 1.

The shield member 14 is formed as the annular plate body extending in the radial outward from the outer peripheral side of the shaping air spurting member 9. Accordingly, the shield member 14 formed of the plate body can be easily provided, making it possible to prevent the contamination due to the adherence of the paint at low costs. In addition, the thin shield member 14 can concentrate the electric flux lines on the peripheral edge part 14C.

Further, the shield member 14 is formed to be integral with the shaping air spurting member 9. Therefore, the electric potential of the shield member 14 can be maintained at the ground level through the shaping air spurting member 9. Based thereupon, the event that the paint enters a mounting clearance between the shaping air spurting member 9 and the shield member 14 can be prevented in advance, therefore shortening the washing time.

On the other hand, the shield member 14 having the electric potential which is maintained at the ground level is provided between the rotary atomizing head 4 and each of the electrodes 6C. In the shield member 14, as the outer diameter dimension becomes larger, a rate of absorbing a part of the electrified energy toward the sprayed paint from each of the electrodes 6C becomes the larger. The shield member 14 has a tendency that as the outer diameter dimension is larger, the return of the paint particles can be the more suppressed and as the outer diameter dimension is smaller, the paint particles are the more likely to be electrified. However, an optimal outer diameter dimension that has saturation properties both in a large dimension and in a small dimension, is resistant to contamination and has good electrified efficiency is selected and determined. This diameter dimension is determined by a size of the rotary atomizing head 4 (bell cup), a desirable spray effective outer diameter at coating or the like.

On the other hand, at a coating work, electric flux lines 28 are formed between each of the electrodes 6C and the outer peripheral surface of the insulating member 15. Since the insulating member 15 is electrified to a high voltage by the electric flux lines 28, the discharge is generated between the enlarged diameter part 15C of the insulating member 15 and the peripheral edge part 14C of the shield member 14. When the discharge is repeated, electric degradation is possibly generated in the enlarged diameter part 15C of the insulating member 15.

Therefore, according to the first embodiment, the discharge buffering member 16 is disposed between the shield member 14 and the insulating member 15. The discharge buffering member 16 is formed as the annular body made of ceramic (self-returning insulator) or a semiconductor material provided in a position of separating the shield member 14 from the insulating member 15. Consequently, even when the discharge from the insulating member 15 to the shield member 14 is performed, since the discharge buffering member 16 disposed therebetween is formed of ceramic or a semi conductive member excellent in rigidity, thermal resistance and the like, it is possible to improve endurability by a function of being capable of preventing electric degradation due to the discharge or a function of eliminating partial discharge by gradually discharging the electric charge.

In addition, the discharge buffering member 16 is formed by the disc part 16A formed of the annular plate body facing the rear surface part 14B of the shield member 14 and the cylindrical part 16B extending to the opposite side (rear side) of the shield member 14 from the inner diameter side of the disc part 16A. Accordingly, the line in which the electric charge electrified to the surface of the insulating member 15 flows includes the discharge line A and the discharge line B that have the base point C as the outer peripheral section 15C3 of the enlarged diameter part 15C. The discharge line A leads from base point C through the rear surface 16A2, the outer peripheral surface 16A3 and the front surface 16A1 of the disc part 16A of the discharge buffering member 16 to the peripheral edge part 14C of the shield member 14. In addition, the discharge line B leads from the base point C through the rear surface 16A2 of the disc part 16A, the outer peripheral surface 16B2 and the rear surface 16B3 of the disc part 16B of the discharge buffering member 16 to the outer peripheral surface 9B of the shaping air spurting member 9. In this case, the discharge line B is formed to be more elongated than the discharge line A by the disc part 16A and the cylindrical part 16B. Also, in this point, it is possible to prevent electric degradation of the insulating member 15 due to the current flow in the discharge line B to improve endurability and reliability.

The coating machine support body 2 is provided on the outer peripheral side of the air motor 3 to surround the air motor 3 and extend closer to the rearward than the air motor 3. In addition, the external electrode member 6 includes the annular external electrode support tubular body 6A that is provided on the outer peripheral side of the coating machine support body 2 and is formed of an insulating plastic material, and the plurality of electrodes 6C that are arranged in the circumferential direction on the front end side of the external electrode support tubular body GA. Accordingly, the external electrode member 6 can be arranged on the outer peripheral side of the coating machine support body 2 in the insulating state. Further, since the plurality of electrodes 6C can be arranged in a compact manner, the external electrode member 6 can be miniaturized to provide a coating machine suitable for the coating in a narrow place.

The inner cover member 7 and the outer cover member 8 formed in a tubular shape with an insulating material and surrounding the air motor 3 are provided between the external electrode member 6 and the shaping air spurting member 9. Accordingly, the air motor 3 can be covered and hidden with the respective cover members 7, 8. Even when the paint adheres to the outer cover member 8 formed to be smooth and in an arc shape, the adhered paint can be securely washed for a short time.

Further, since the shield member 14 is formed in a flange shape, the electric flux lines 26 concentrate on the peripheral edge part 14C to generate discharge. The ion particles due to the discharge collide with the paint particles in front of the rotary atomizing head 4 by the air flow of the shaping air. As a result, the paint particles can be electrified in the electrified area 27 where the paint particles are sufficiently accelerated toward the coating object 17.

Figure 7:
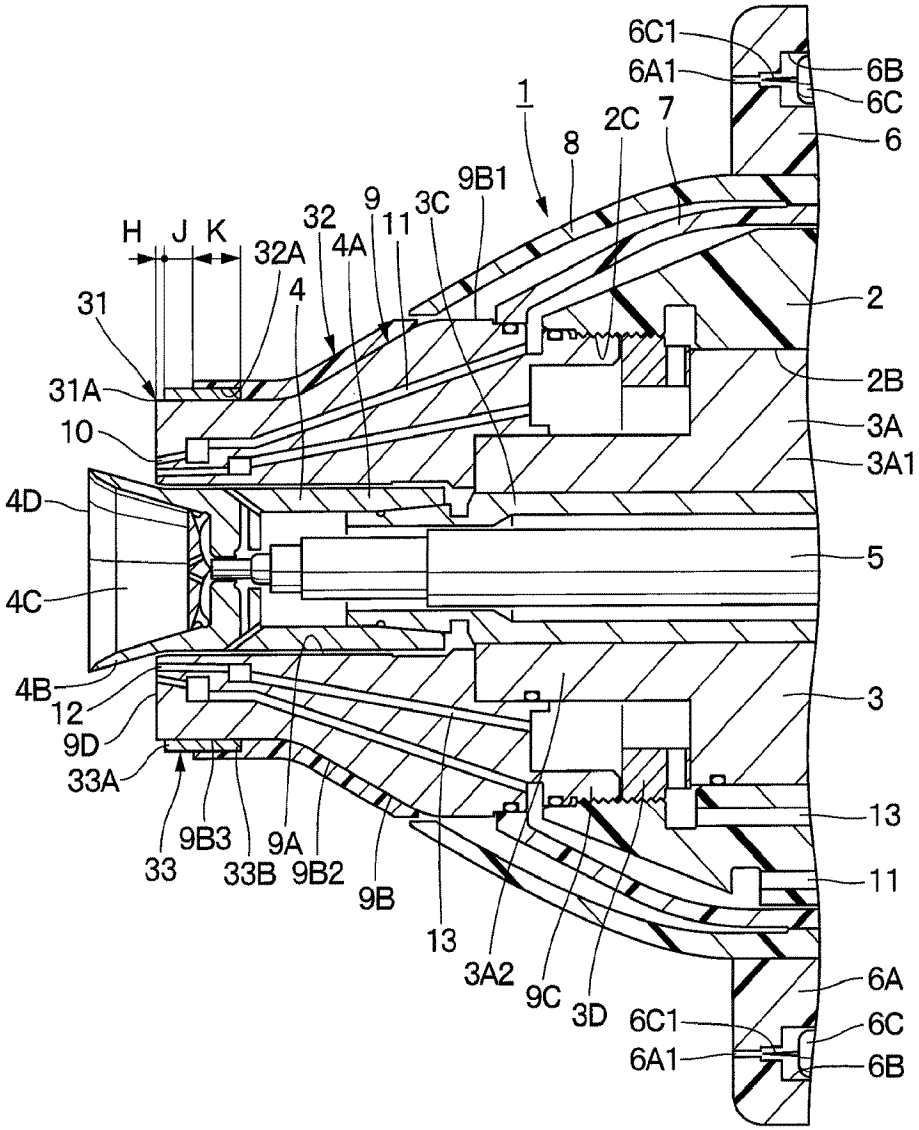
FIG. 7 is a cross sectional view showing a front side portion of a rotary atomizing head type electrostatic coating machine according to a second embodiment, as viewed in a position similar to that in FIG. 3.

Next, FIG. 7 shows a second embodiment of the present invention. The second embodiment is characterized in that a discharge buffering member is formed as an annular tubular body that surrounds the periphery of a shaping air spurting member. In this second embodiment, components identical to those in the aforementioned first embodiment will be referred as the identical reference numerals and its explanation is omitted.

In FIG. 7, a shield member 31 according to the second embodiment is provided to be integral with the shaping air spurting member 9 by forming an outer peripheral side of the shaping air spurting member 9 to be thicker. The shield member 31 is formed, for example, to be thicker to a position of shielding a straight line connecting the needle part 6C1 of each of the electrodes 6C in the external electrode member 6 and the releasing edge 4D of the rotary atomizing head 4. On this condition, an outer peripheral section of a front end of the shield member 31 is formed as a substantially right-angled corner part 31A. This corner part 31A, as similar to the peripheral edge part 14C of the shield member 14 according to the first embodiment, can make a concentration of electric flux lines between each of the electrodes 6C and the rotary atomizing head 4 thin by formation of the electric flux lines between each of the electrodes 6C and the corner part 31A.

An insulating member 32 according to the second embodiment, as similar to the insulating member 15 according to the first embodiment, covers the outer peripheral side of the shaping air spurting member 9, and is formed as a tubular body made of a highly insulating material. The insulating member 32 has a front end that is disposed in the vicinity of the corner part 31A of the shield member 31 and an inner peripheral side of the front side that is provided with a fitting part 32A in which a discharge buffering member 33 to be described later is fitted.

The discharge buffering member 33 according the second embodiment, as similar to the discharge buffering member 16 according to the first embodiment, is an insulating material, and is formed using a self-returning insulator, such as ceramic. Specifically, the discharge buffering member 33 is formed as an annular tubular body surrounding the periphery of the shaping air spurting member 9. The discharge buffering member 33 may be formed using a semiconductor material.

A front end part 33A of the discharge buffering member 33 is formed in a position of shielding a straight line connecting the needle part 6C1 of each of the electrodes 6C in the external electrode member 6 and the corner part 31A of the shield member 31. This enables the electrification amount by the electric flux lines traveling toward the shield member 14 from each of the electrodes 6C to decay. A rear end part 33B of the discharge buffering member 33 is inserted in the fitting part 32A of the insulating member 32.

Here, descriptions will be made of an axial (front-rear direction) arrangement relation of the shield member 31, the insulating member 32 and the discharge buffering member 33. A dimension from the corner part 31A of the shield member 31 to the front end part 33A of the discharge buffering member 33 is indicated at H, a dimension from the front end part 33A of the discharge buffering member 33 to the front end of the insulating member 32 is indicated at J and a dimension from the front end of the insulating member 32 to the rear end part 33B of the discharge buffering member 33 is indicated at K. In this case, an explanation will be made of the dimension H and the dimension K on a basis of the dimension J from the front end part 33A of the discharge buffering member 33 to the front end of the insulating member 32. That is, the dimension J and the dimension K have a relationship of the following Formula 4.

$$1.5J \leq K \leq 2.0J \quad \text{[Formula 4]}$$

Consequently, it is possible to cause the electric charge electrified to the insulating member 32 to flow to the shield member 31 on a surface of the discharge buffering member 33 through a discharge line in the front side short in creepage distance. The dimension H is set according to the following Formula 5.

$$0 \leq H \leq J \quad \text{[Formula 5]}$$

That is, the front end part 33A of the discharge buffering member 33 can be disposed to be aligned with the corner part 31A of the shield member 31.

In this way, the second embodiment as configured above can also acquire a functional effect substantially similar to that of the aforementioned first embodiment. Particularly according to the second embodiment, it is possible to reduce concavity and convexity due to the shield member 31 and make the washing characteristics good.

Figure 8:
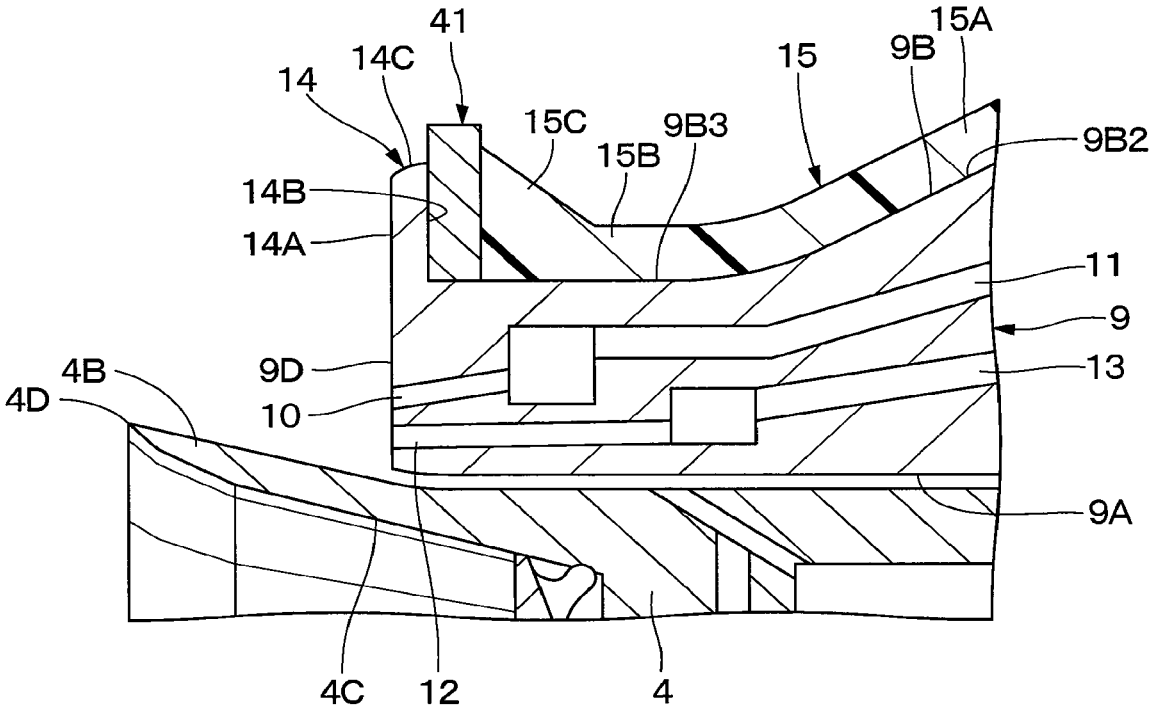
FIG. 8 is a cross sectional view showing a discharge buffering member according to a first modification together with a shield member, an insulating member and the like, as viewed in a position similar to that in FIG. 4.

It should be noted that the first embodiment shows, as an example, that the discharge buffering member 16 is formed by the disc part 16A formed of the annular plate body facing the rear surface part 14B of the shield member 14 and the cylindrical part 16B extending to the opposite side of the shield member 14 from the inner diameter side of the disc part 16A. However, the present invention is not limited thereto, and may be configured as a first modification shown in FIG. 8, for example. That is, a discharge buffering member 41 according to the first modification may be formed as an annular plate body facing the rear surface part 14B of the shield member 14.

Figure 9:
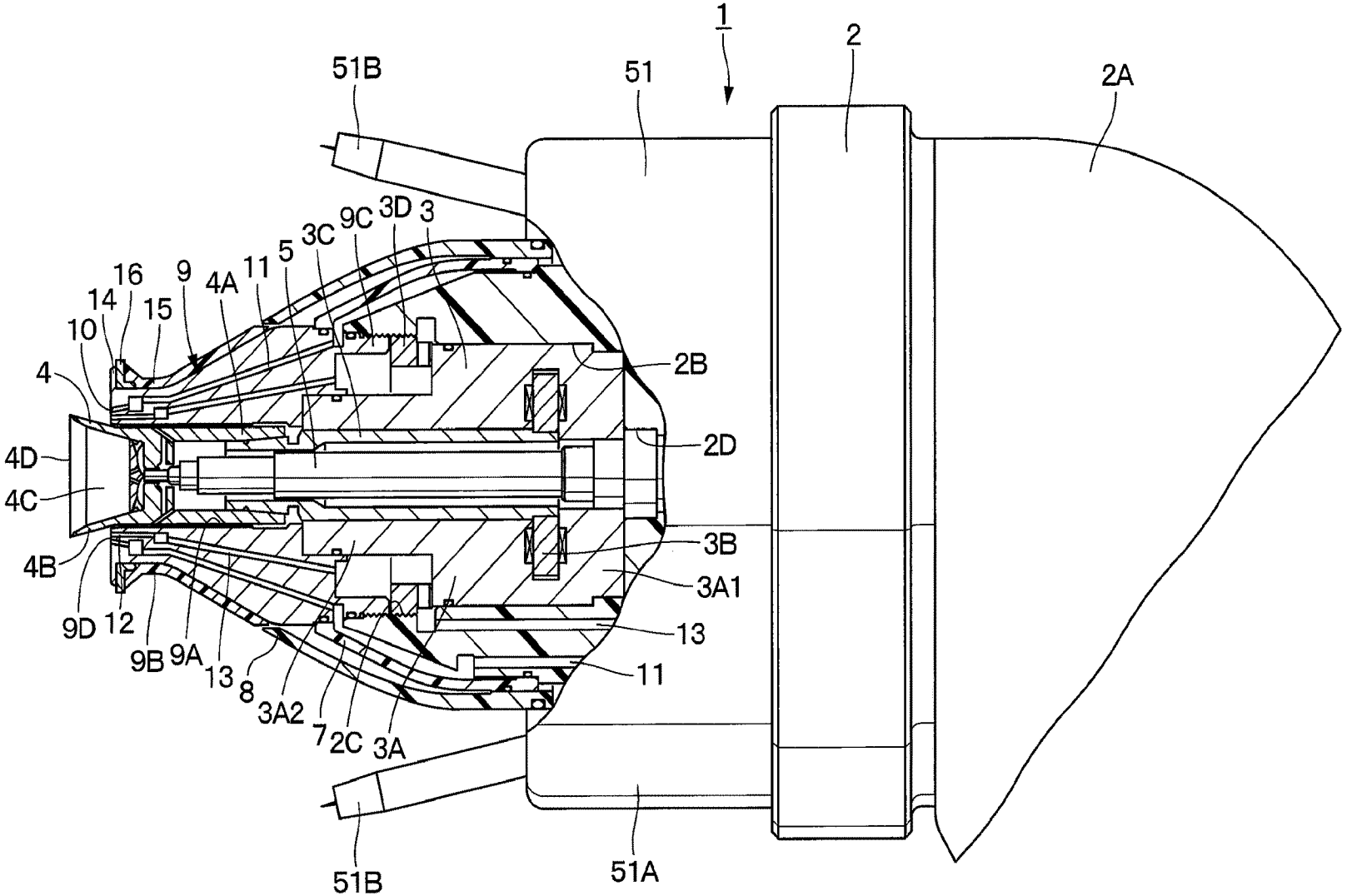
FIG. 9 is a cross sectional view showing a rotary atomizing head type electrostatic coating machine provided with an external electrode member according to a second modification.

The first embodiment shows as an example a case where the external electrode member 6 includes the annular external electrode support tubular body 6A that is provided on the outer peripheral side of the coating machine support body 2, the plurality of electrode mounting holes 6B that are arranged in the annular external electrode support tubular body 6A by equal intervals in the circumferential direction, and the electrodes 6C that are mounted in the electrode mounting holes 6B respectively. However, the present invention is limited thereto, but may be configured as a second modification as shown in FIG. 9, for example. That is, an external electrode member 51 according to the second modification includes an annular external electrode support tubular body 51A that is provided on an outer peripheral side of the coating machine support body 2, a plurality of electrodes 51B that are arranged on the front part of the annular external electrode support tubular body 51A by equal intervals in a circumferential direction to extend forward. These configurations may be likewise applied to the other embodiments.

The first embodiment shows as an example a case where the shield member 14 is formed as the annular plate body extending from the outer peripheral side of the shaping air spurting member 9 to the radial outward. However, the present invention is not limited thereto, but, for example, a shield member may be formed in a tapered shape by being inclined forward toward the radial outside. Further, a shield member may be provided to be separated from a shaping air spurting member and may be configured to be mounted integrally on the shaping air spurting member using means such as fitting or screwing.

Further, the second embodiment shows as an example a case where the fitting part 32A is provided in the insulating member 32 and the discharge buffering member 33 is fitted in the fitting part 32A. However, the present invention isnot limited thereto, but, for example, the fitting part 32A may be abolished to dispose the insulating member 32 to overlap on the outer peripheral side of the discharge buffering member 33. In addition, an annular concave groove may be formed on an outer peripheral surface of a shaping air spurting member to cause a discharge buffering member to be fitted in the annular concave groove.

DESCRIPTION OF REFERENCE NUMERALS

1: Rotary atomizing head type electrostatic coating machine
2: Coating machine support body
3: Air motor
3C: Rotational shaft
4: Rotary atomizing head
4D: Releasing edge (Front end)
6, 51: External electrode member
6C, 51B: Electrode
9: Shaping air spurting member
9B: Outer peripheral surface
9D: Front surface section (Front side section)
10: First air spurting hole (Air spurting hole)
12: Second air spurting hole (Air spurting hole)
14, 31: Shield member
14B: Rear surface part (Rear surface)
15, 32: Insulating member
16, 33, 41: Discharge buffering member
16A: Disc part
16B: Cylindrical part

The invention claimed is:

1. An electrostatic coating machine comprising:

an air motor having an electric potential which is maintained at a ground level and that rotates a rotational shaft with compressed air supplied;

a rotary atomizing head that is provided on the front side of the rotational shaft and is composed of a tubular body having an electric potential which is maintained at the ground level to spray paint, which is supplied while being rotated by the air motor, from a releasing edge in a front end;

an external electrode member that is positioned in back of the rotary atomizing head and is provided on an outer peripheral side of the air motor to electrify paint particles sprayed from the releasing edge in the rotary atomizing head to be in a negative potential by applying a negative high voltage to a plurality of electrodes; and a shaping air spurting member that is formed in a tubular shape by using a conductive material and is arranged on an outer peripheral side of the rotary atomizing head in a state where a front end is positioned in an intermediate section of the rotary atomizing head in a length direction, the front end being provided with a plurality of air spurting holes over an entire circumference in a circumferential direction to spurt shaping air toward paint particles sprayed from the rotary atomizing head;

a shield member is provided on an outer peripheral side of a front side section of the shaping air spurting member and is formed of an annular body radially extending to shield electric flux lines traveling toward the rotary atomizing head from each of the electrodes in the external electrode member;

a tubular insulating member formed of an insulating material covering an outer peripheral surface of the shaping air spurting member is provided on an outer peripheral side of the shaping air spurting member; and a discharge buffering member of an annular self-returning insulator or semi-conductive material is provided in a position where the shield member is separated from the insulating member and the discharge buffering member is located between the shield member and the insulating member, wherein a front surface of the discharge buffering member abuts on a rear surface of the shield member, wherein a front surface of the tubular insulating member abuts on a rear surface of the discharge buffering member, and wherein a front surface of the shield member is flush with a front surface of the shaping air spurting member.

2. The electrostatic coating machine according to claim 1, wherein the shield member is formed as an annular plate body that extends from the outer peripheral side of the shaping air spurting member toward a radial outward direction, and the discharge buffering member is formed as an annular plate body facing a rear surface part of the shield member.

3. The electrostatic coating machine according to claim 1, wherein the discharge buffering member is formed by an annular plate body facing a rear surface part of the shield member and a cylindrical part extending away from the rear surface part of the shield member from an inner diameter side of the annular plate body.

4. The electrostatic coating machine according to claim 1, wherein the discharge buffering member is formed as an annular tubular body surrounding the periphery of the shaping air spurting member.

* * * * *